US006693267B2

(12) United States Patent
Shimizu et al.

(10) Patent No.: US 6,693,267 B2
(45) Date of Patent: Feb. 17, 2004

(54) PORTABLE MICROWAVE OVEN

(75) Inventors: Ari Koji Shimizu, Rio Claro (BR); Willian Harley Garcia, Rio Claro (BR); Cláudia Alquezar Facca, São Bernardo do Campo (BR); Rogério Ferreira Negrão, Joinville (BR)

(73) Assignee: Multibras S.A. Eletrodomesticos, Sao Paulo (BR)

( * ) Notice: Subject to any disclaimer, the term of this patent is extended or adjusted under 35 U.S.C. 154(b) by 0 days.

(21) Appl. No.: 10/181,844

(22) PCT Filed: Feb. 2, 2001

(86) PCT No.: PCT/BR01/00013

§ 371 (c)(1),
(2), (4) Date: Nov. 1, 2002

(87) PCT Pub. No.: WO01/58217

PCT Pub. Date: Aug. 9, 2001

(65) Prior Publication Data

US 2003/0168448 A1 Sep. 11, 2003

(30) Foreign Application Priority Data

Feb. 4, 2000 (BR) ..... 0002043

(51) Int. Cl.[7] ..... H05B 6/80

(52) U.S. Cl. ..... 219/756; 219/739; 219/762; 99/DIG. 14

(58) Field of Search ..... 219/756, 725, 219/732, 762, 763, 739; 99/DIG. 14

(56) References Cited

U.S. PATENT DOCUMENTS

| | | | | | |
|---|---|---|---|---|---|
| 4,762,973 | A | | 8/1988 | Schultz | 219/10.55 |
| 5,369,255 | A | * | 11/1994 | Sherer et al. | 219/725 |
| 5,893,997 | A | | 4/1999 | Gustafsson | 219/756 |
| D456,666 | S | * | 5/2002 | Monguilod | D7/351 |

FOREIGN PATENT DOCUMENTS

| | | | | |
|---|---|---|---|---|
| EP | 0 865 228 | | 9/1998 | H05B/6/74 |
| JP | 5-44943 | * | 2/1993 | 219/756 |

* cited by examiner

*Primary Examiner*—Philip H. Leung
(74) *Attorney, Agent, or Firm*—Darby & Darby

(57) ABSTRACT

A portable microwave oven, formed by a hollow prismatic body (10) defining an internal cooking chamber (20) formed between a first polygonal base (30) and a second polygonal base (40) of said body (10) and a peripheral lateral wall (50), the first polygonal base (30) externally defining a first seating surface (31) of the oven, the second polygonal base (40) being at least partially defined by a tiltable door (60) that gives access to the cooking chamber (20), the peripheral lateral wall (50) defining, in part of its extension, a second seating surface (52) of the oven, the cooking chamber (20) being provided with a first product supporting surface (21) and a second product supporting surface (22) in a position usually displaced in 90 degrees in relation to the operative position when using the first product supporting surface (21).

6 Claims, 5 Drawing Sheets

PORTABLE MICROWAVE OVEN

FIELD OF THE INVENTION

The present invention refers to a new construction applied to a microwave oven, which gives the latter the characteristic of easy portability, allowing said microwave oven to be used in different conditions, in residences, trips, inside vehicles or in any other place where the user has access to a power source of usual or reduced voltage.

BACKGROUND OF THE INVENTION

There are known in the art and widely used the microwave ovens usually comprising a parallepipedic cabinet, whose inside is accessed by the user through an oscillating front door with a vertical lateral hinge or by a tiltable front door with a horizontal lower hinge.

These parallepipedic cabinets are usually seated on benches, shelves or supports, which are affixed to walls of a respective room of a building, at a height that makes easy for the user to access the inside of the oven by opening its front door.

While operating adequately, these microwave ovens of the prior art are not normally portable, though, if desired, the user may carry them to different places of operation. However, this displacement does not give these ovens the characteristic of portability, but rather of transportability. Although they may be carried from one place of operation to another, inside or out of the user's home, these appliances cannot be easily carried by a person of any size or age, and it is not possible to use them in motor vehicles during a trip or in certain situations in which it is necessary to heat small recipients in conditions in which the usual microwave ovens of parallepipedic cabinets are not normally available.

DISCLOSURE OF THE INVENTION

Thus, it is an object of the present invention to provide a microwave oven, which has light weight, small dimensions and which is designed to allow easy portability.

It is a further object of the present invention to provide a portable microwave oven of the above mentioned type, which may be operated by using an electrical power source of reduced voltage.

It is a still further object of the present invention to provide a portable microwave oven of the type considered above, which allows, by means of a body with substantially reduced dimensions, to operatively lodge, in its inside, recipients having a height that is substantially larger than the contour of its cross-section, as well as recipients with a reduced height in relation to the contour of its cross-section.

The objectives above are achieved by providing a portable microwave oven formed by a hollow prismatic body defining an internal cooking chamber formed between a first polygonal base and a second polygonal base of the body and a peripheral lateral wall, said polygonal bases being usually parallel to and spaced from each other by a distance that is substantially smaller than the smallest width of the first and second polygonal bases, the first polygonal base externally defining a first seating surface of the oven, when the latter operates with the axis of the body in the vertical position, the second polygonal base being at least partially defined by a tiltable door that gives access to the cooking chamber, the peripheral lateral wall defining, in part of its extension, a second seating surface of the oven, when the latter operates with the axis of the body in the horizontal position, the cooking chamber being provided with a first product supporting surface, which is parallel to the first seating surface of the oven, and with a second product supporting surface, which is parallel to the second seating surface of the oven.

BRIEF DESCRIPTION OF THE DRAWINGS

The invention will be described below, with reference to the attached drawings, in which.

BEST MODE OF CARRYING OUT THE INVENTION

Figure 1:
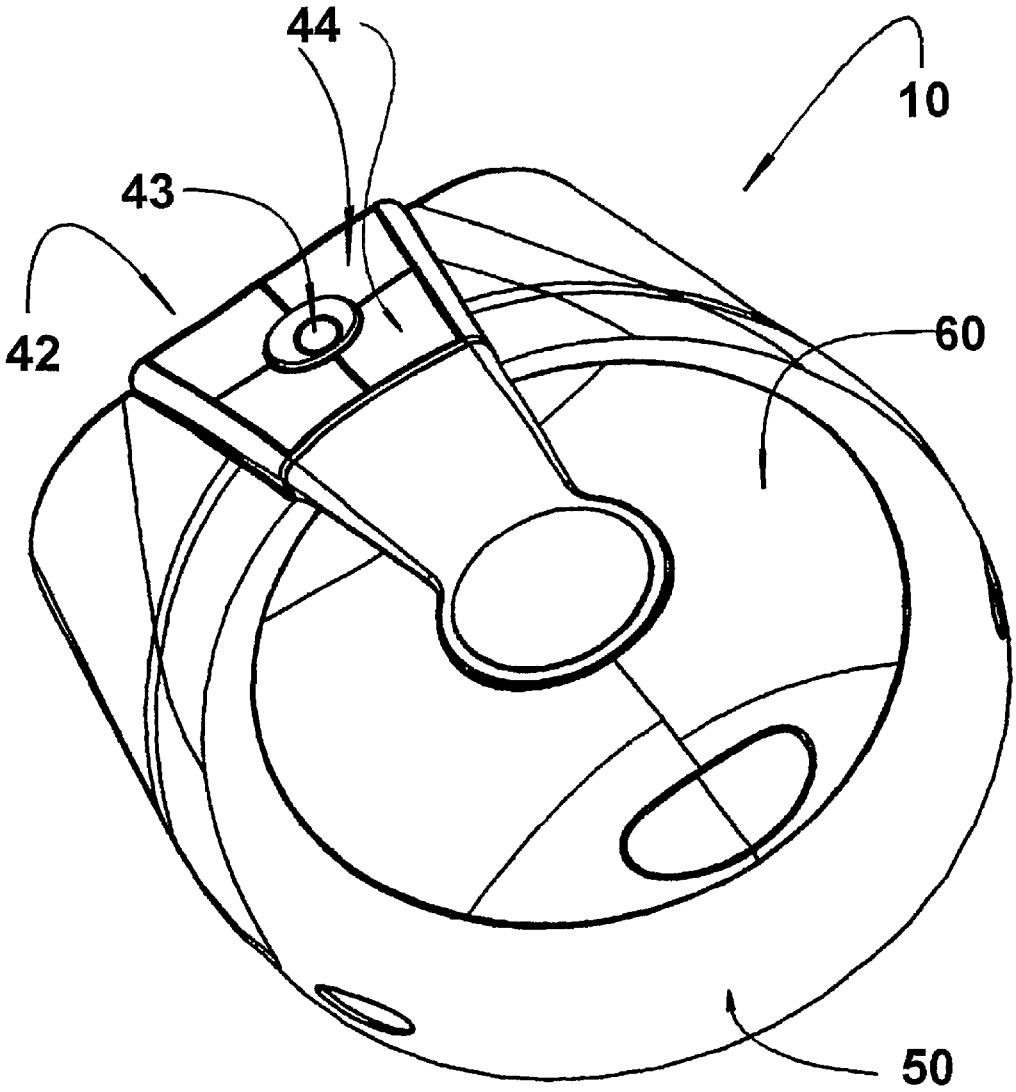
FIG. 1 is a front lateral upper perspective view of the portable microwave oven.
Figure 2:
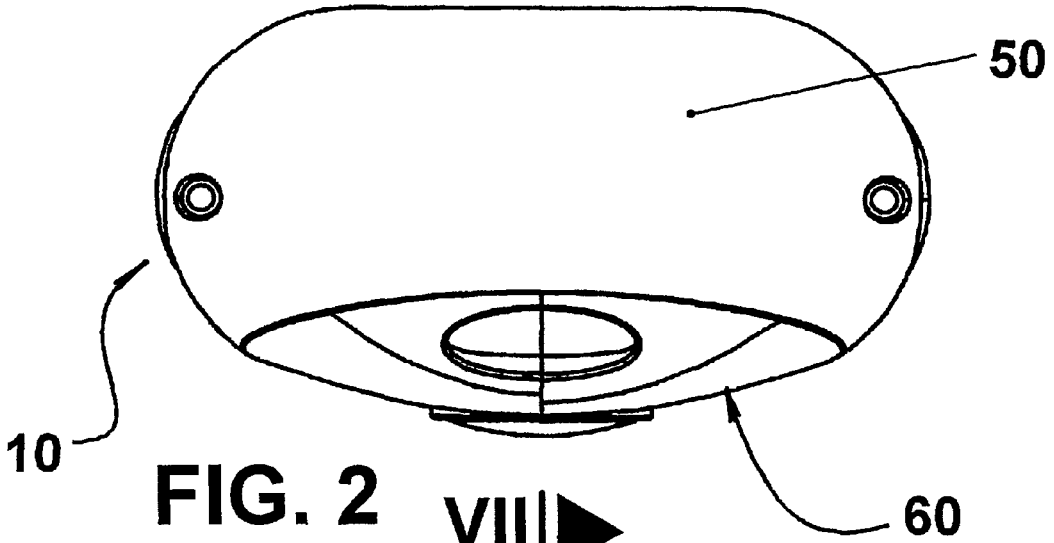
FIG. 2 is an upper plan view of the portable microwave oven of FIG. 1.
Figure 3:
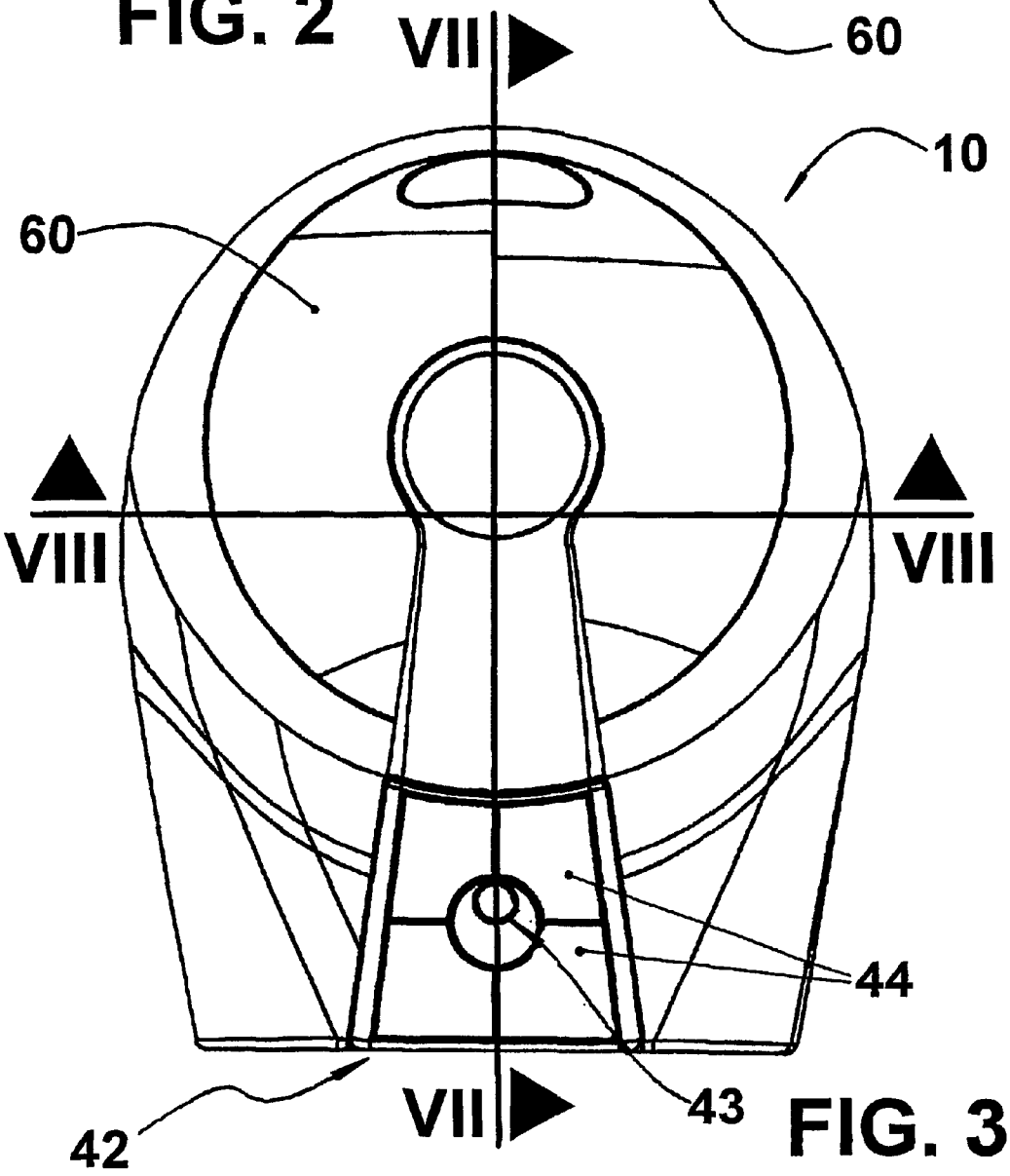
FIG. 3 is a front elevational view of the portable microwave oven of FIGS. 1 and 2.
Figure 4:
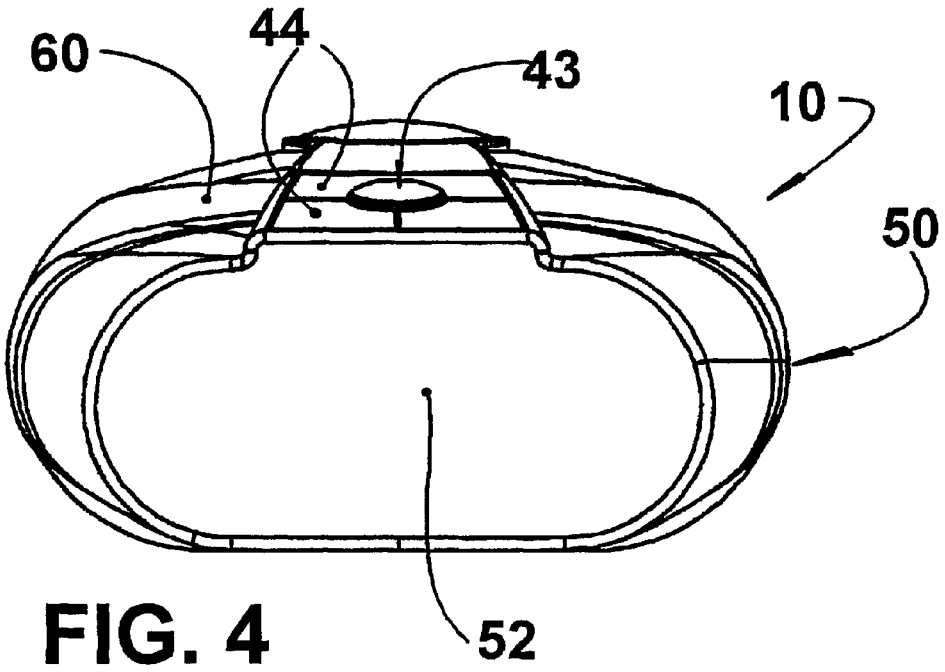
FIG. 4 is a bottom plan view of the portable microwave oven of FIGS. 1–3.
Figure 5:
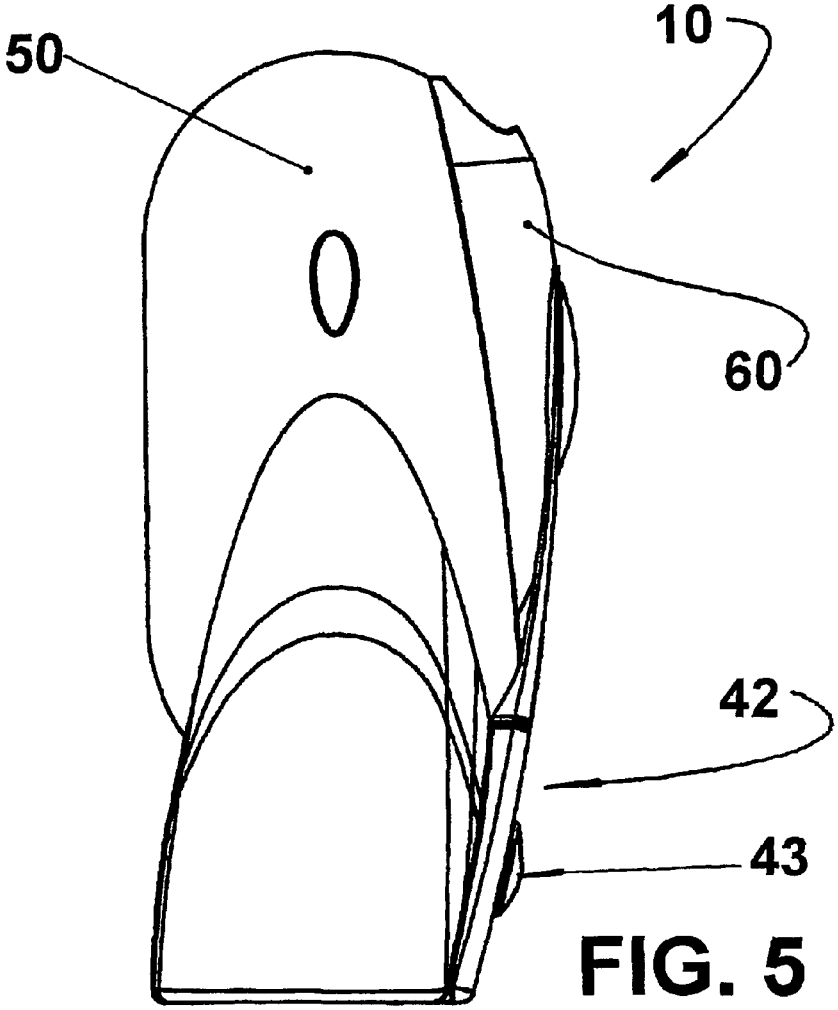
FIG. 5 is a lateral elevational view of the portable microwave oven of FIGS. 1–4.
Figure 6:
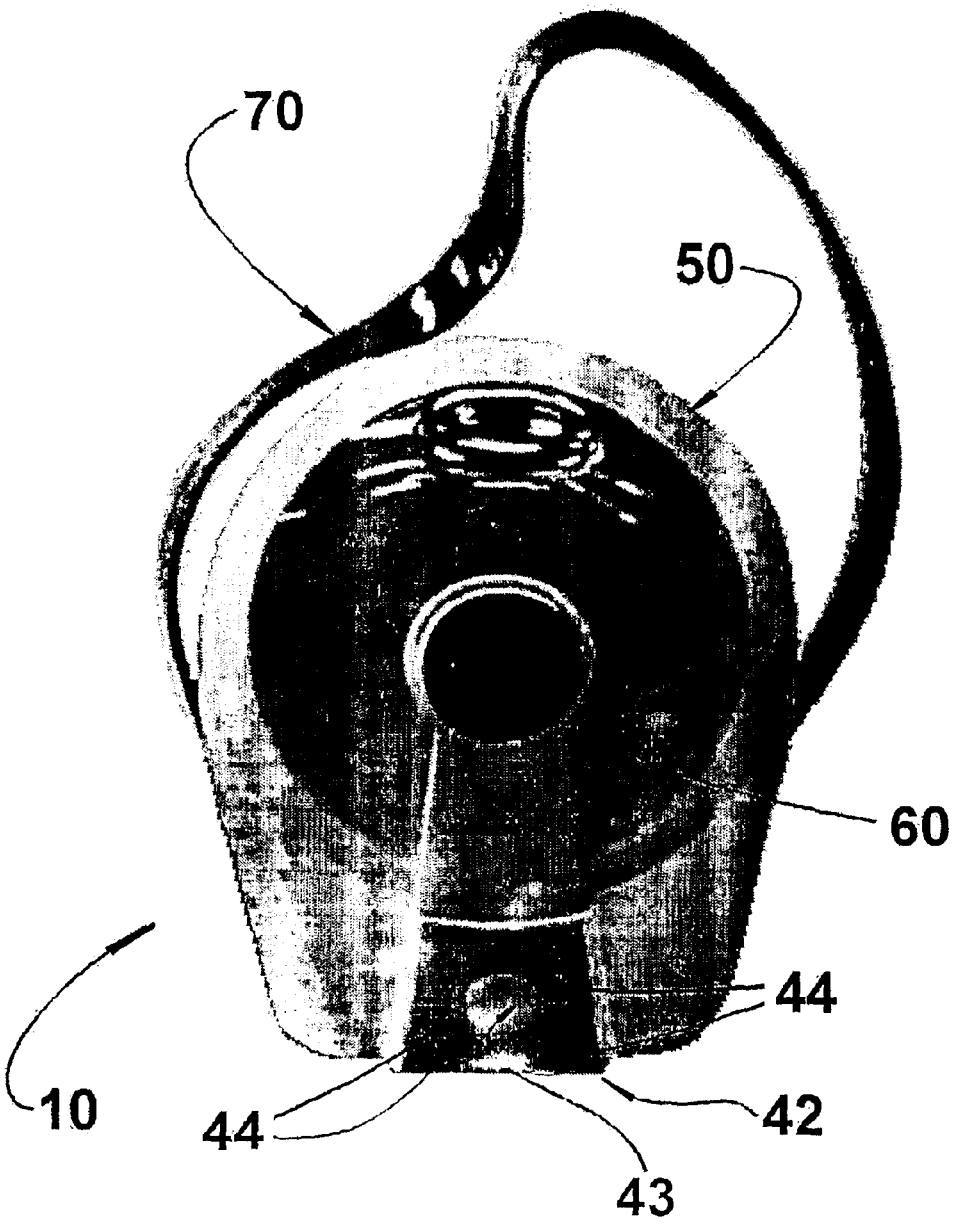
FIG. 6 is a front elevational view of the portable microwave oven of FIGS. 1–5, said view illustrating the oven provided with a shoulder belt.
Figure 7:
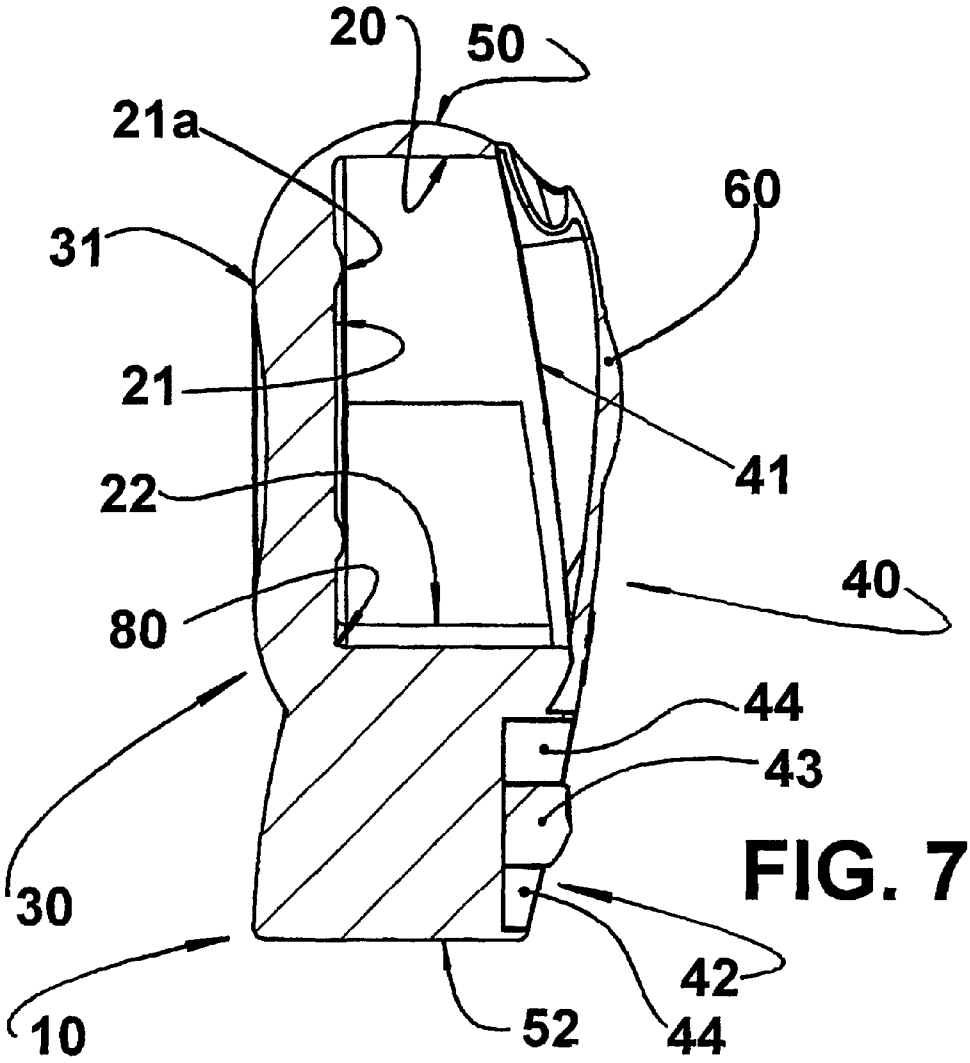
FIGS. 7 and 8 are cross-sectional views of the portable microwave oven of the previous figures, said views being taken according to lines VII—VII and VIII—VIII of FIG. 3.
Figure 8:
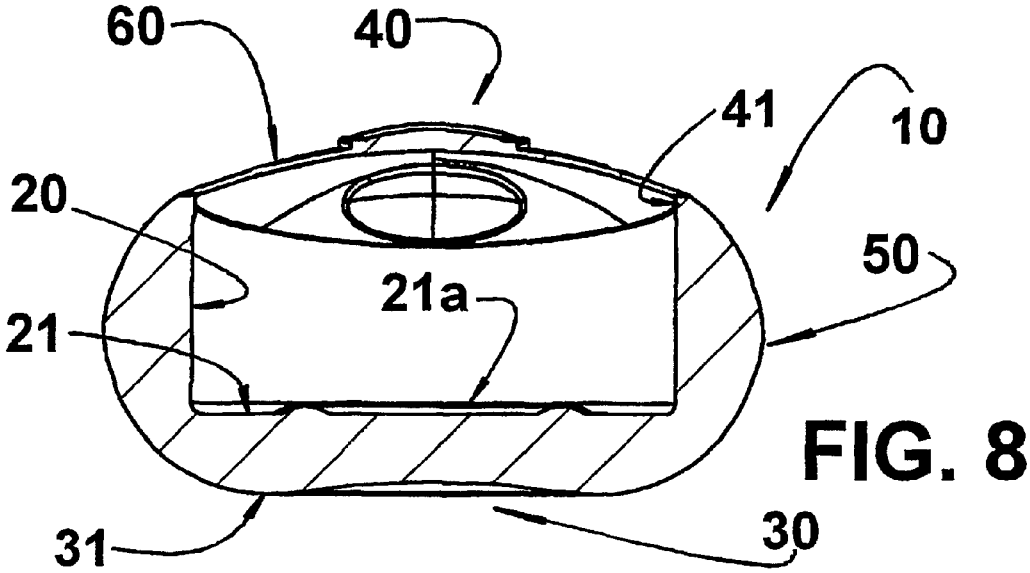

According to the illustrations above, the portable microwave oven is defined by a hollow prismatic body 10, defining internally a cooking chamber 20, which is provided between a first polygonal base 30 and a second polygonal base 40, which are usually parallel to and spaced from each other by a distance that is substantially smaller than the smallest width of said first and second polygonal bases 30, 40, and by a peripheral lateral wall 50, said chamber 20 presenting a substantially cylindrical shape as a preferred embodiment.

According to a first aspect of the present invention, the first polygonal base 30 defines, externally, a first seating surface 31 of the oven, which allows the latter to assume an operative position in which the axis of said body 10 is vertically positioned and defines, inside the cooking chamber 20, a first supporting surface 21 for the product to be prepared in the microwave oven, said first supporting surface incorporating a circular rib 21*a* and lying on a plane parallel to said seating surface 31 of the oven.

The second polygonal base 40 is provided with a median opening 41 which, according to the preferred embodiment, is circular and occupies a substantial area of said second polygonal base, said median opening 41 being provided with a tiltable door 60, which may be displaced between a closed position, in which it is seated against the free edge of the median opening 41, hermetically closing the cooking chamber 20, and an open position, giving access to the inside of the cooking chamber 20.

At a portion of the second polygonal base 40 external to the median opening 41 and to the tiltable door 60, there is provided a control panel 42 which, in the illustrated example, is defined by a central button of the rotary encoder type and which is surrounded by four function keys 44.

According to a second aspect of the invention, the peripheral lateral wall 50 is provided with a chamfer that forms a second seating surface 52 of said oven, orthogonal to the first seating surface 31 and which allows said oven to be operated in a second operational position, in which the axis of the body 10 is horizontal.

The cylindrical lateral wall of the chamber 20 is provided with a chamfer that forms a second product supporting surface 22 for the product to be prepared in said microwave oven, said second product supporting surface 22 being positioned orthogonal to the first supporting surface 21, parallel to the second seating surface 52 and being taken to an operative position when the microwave oven is angularly displaced from the first operative position, with the axis of the body 10 on the horizontal, to a second operative position, in which said axis is taken to a vertical position.

According to the constructive description of two aspects of the invention, the present microwave oven has two operative positions for preparing food. In the first position, the food may be contained in a recipient with a horizontal cross-section, with a contour limited by the contour of the area of the first supporting surface 21 and with the height limited by the distance between the two polygonal bases 30 and 40.

In the second operative position of the oven, the recipient has a horizontal cross-section, with a contour limited by the contour of the area of the second product supporting surface 22 and the height limited by the smallest cross-sectional dimension of the cooking chamber 20 taken on a plan orthogonal to said second product supporting surface 22.

On the peripheral lateral wall 50 of the oven, there are rotatively affixed the free ends of a shoulder belt 70, which allows the user to carry said microwave oven anywhere.

In the illustrated embodiment, the first and the second product supporting surfaces 21 and 22 are flat and have a common intersection line 80.

What is claimed is:

1. A portable microwave oven, characterized in that it is formed by a hollow prismatic body (10) defining an internal cooking chamber (20) formed between a first polygonal base (30) and a second polygonal base (40) of said body (10) and a peripheral lateral wall (50), said polygonal bases (30, 40) being usually parallel to and spaced from each other by a distance that is substantially smaller than the smallest width of the first and the second polygonal bases (30, 40), the first polygonal base (30) externally defining a first seating surface (31) of the oven when the latter operates with the axis of the body (10) in the vertical position, the second polygonal base (40) being at least partially defined by a tiltable door (60) that gives access to the cooking chamber (20), the peripheral lateral wall (50) defining, in part of its extension, a second seating surface (52) of the oven, when the latter operates with the axis of the body in the horizontal position, the cooking chamber (20) being provided with a first product supporting surface (21), which is parallel to the first seating surface (31) of the oven, and with a second product supporting surface (22), which is parallel to the second seating surface (52) of the oven.

2. The portable microwave oven according to claim 1, characterized in that the tiltable door (60) is at least partially transparent.

3. The portable microwave oven according to claim 1, characterized in that the tiltable door (60) is hinged according to an axis that is substantially parallel to and slightly spaced back in relation to the second product supporting surface (22).

4. The portable microwave oven according to claim 1, characterized in that, in the peripheral lateral wall (50) of the body (10) are rotatively affixed the free ends of a shoulder belt (70).

5. The portable microwave oven according to claim 1, characterized in that the first and the second product supporting surfaces (21, 22) of the cooking chamber (20) are flat, the first product supporting surface (21) incorporating a circular rib **(21*a*)**.

6. The portable microwave oven according to claim 1, characterized in that the first product supporting surface (21) and the second product supporting surface (22) have a common intersection line (80).

* * * * *